United States Patent [19]

Jones

[11] 4,420,050

[45] Dec. 13, 1983

[54] OIL WELL DRILLING BIT

[75] Inventor: Kenneth W. Jones, Kingwood, Tex.

[73] Assignee: Reed Rock Bit Company, Houston, Tex.

[21] Appl. No.: 264,885

[22] Filed: May 18, 1981

Related U.S. Application Data

[63] Continuation of Ser. No. 62,260, Jul. 30, 1979, abandoned.

[51] Int. Cl.[3] ..... E21B 10/16

[52] U.S. Cl. ..... 175/374; 175/376; 175/378

[58] Field of Search ..... 175/374, 375, 376, 377, 175/378, 410

[56] References Cited

U.S. PATENT DOCUMENTS

| | | | |
|---|---|---|---|
| 2,122,759 | 7/1938 | Scott | 175/377 |
| 2,626,128 | 1/1953 | Boice | 175/374 |
| 2,749,093 | 6/1956 | Peter | 175/377 |
| 2,774,570 | 12/1956 | Cunningham | 175/374 |
| 2,990,025 | 6/1961 | Talbert et al. | 175/378 |
| 3,385,385 | 5/1978 | Kucera et al. | 175/378 |
| 3,696,876 | 10/1972 | Ott | 175/374 |
| 3,727,705 | 4/1973 | Neuman | 175/376 |
| 3,952,815 | 5/1978 | Dysart | 175/337 |
| 4,108,260 | 8/1978 | Bozarth | 175/376 |

FOREIGN PATENT DOCUMENTS

| | | | |
|---|---|---|---|
| 456885 | 1/1974 | U.S.S.R. | 175/374 |

*Primary Examiner*—James A. Leppink
*Assistant Examiner*—Hoang C. Dang
*Attorney, Agent, or Firm*—Carl Rowold

[57] ABSTRACT

An oil well drilling bit is disclosed of the type utilizing hard metal inserts in the rolling cutters wherein each row of inserts on each cutter is located thereon in a sinusoidal or varying pattern rather than the strictly circumferential pattern of the prior art.

4 Claims, 4 Drawing Figures

OIL WELL DRILLING BIT

This is a continuation of application Ser. No. 062,260, filed July 30, 1979, by Kenneth W. Jones, for "OIL WELL DRILLING BIT" now abandoned.

BACKGROUND OF THE INVENTION

In the drilling of a borehole through the earth's crusts to penetrate oil or gas bearing formations several types of drill bits are utilized. One category of drill bits is that of the rolling cone or rolling cutter drill bit. Such a bit usually utilizes three of such rolling cone cutters rotatably mounted on downward extending journals each of which protrudes from one of three legs extending downwardly at the lower end of the bit body. In the rolling cone bit category there are basically two types of cutter constructions. The first type is the "milled tooth" bit wherein the conical cutters have protruding cutting elements or milled teeth formed on the surface thereof from the same basic piece of blank stock as the cone. The second category of rolling cone drill bits involves the "insert" type of bits wherein the cones are made of one material and have drilled recesses in the surfaces for receiving hard metal cutting elements termed inserts.

Each type of rolling cone drill bit has advantages and disadvantages. The milled tooth type of bit is advantageous in that broad flat sharpened tooth shapes can be formed on the cutters to provide a wide sharply penetrating cutting action on the bottom hole. These broad flat sharp milled teeth are also tough and fracture resistant since they are made out of the same tough alloy as the cone and are integral parts thereof. The disadvantage in the milled tooth cutter type of bit is that the teeth are particularly susceptible to wear from abrasion and erosion of the alloy in the extended tooth area.

The second type of bit, the insert bit, offers the advantage of the hard metal cutting elements or inserts which are tremendously resistant to such abrasive forces. Usually the inserts are made of a very hard material such as tungsten carbide sintered and compacted into a generally cylindrical-frusto conical shape. Holes are usually bored into the conical cutter to receive the cylindrical end of the insert and the generally frusto conical portion of the insert protrudes from the cutter surface. The disadvantage of the insert type bits is that the inserts generally are not as fracture resistant as the milled tooth cutting elements and therefore cannot be shaped as broad and flat and sharp as the milled teeth. Thus the bottom hole coverage and penetration rate of the insert is less desirable than that of the milled tooth although the insert generally will wear many times longer than the milled tooth.

The conventional insert bits manufactured today generally utilize three rolling cones having circumferential rows of inserts securely attached to the cones by interference fit within the holes bored substantially perpendicular to the surface of the cone. These conventional cutter cones have rows of inserts in circumferential rows around the conical surfaces of the cones. One of the problems incurred in this conventional insert pattern is that because of the deeply bored insert recesses in the conical surfaces a weakening of the cone structure is effected. This weakening must be offset by a thickening of the cone resulting in a circumferential land passing around the cone in the area of the insert locations. This adds to the weight and reduces the effective size of the allowable bearing surface on which the cone is mounted. In addition to the problem of the weakening of the cone structure, which weakening is particularly susceptible to hoop stresses in the cone structure, the insert type construction also suffers from an effect known as gyration when the bit is used to drill relatively tough formations.

Gyration occurs because of the circumferential rows of inserts forming grooves in the rock face being drilled. These parallel grooves leaves one or more raised annular ridges of rock material called a kerf. When this kerf becomes high enough it causes these rows of inserts to follow the grooves formerly cut by the other cutter inserts and results in the drill bit following a non-central axis of rotation. This results in an orbital action of the bit termed "gyration" and is a destructive force on the drill bit. Likewise, the gyration effect reduces the cutting speed of the bit to a negligible amount. The kerf buildup eventually contacts the non-cutting surfaces of the cones and totally stops any cutting action of the bit in the hole. Likewise, the gyration forces introduced are not those for which the bit is designed and as a result, unusual damage usually occurs to the inserts, the cones and the bearings. The present invention overcomes these disadvantages by providing a drill bit cone structure having a unique insert pattern which reduces failures from hoop stresses on the cone structure and greatly prevents gyration and tracking of the conical cutters of the drill bit. This pattern of insert placement on the conical cutters is a series of non-linear circumferential or annular bands of inserts on the cutter surfaces.

DESCRIPTION OF THE PREFERRED EMBODIMENTS

Figure 1:
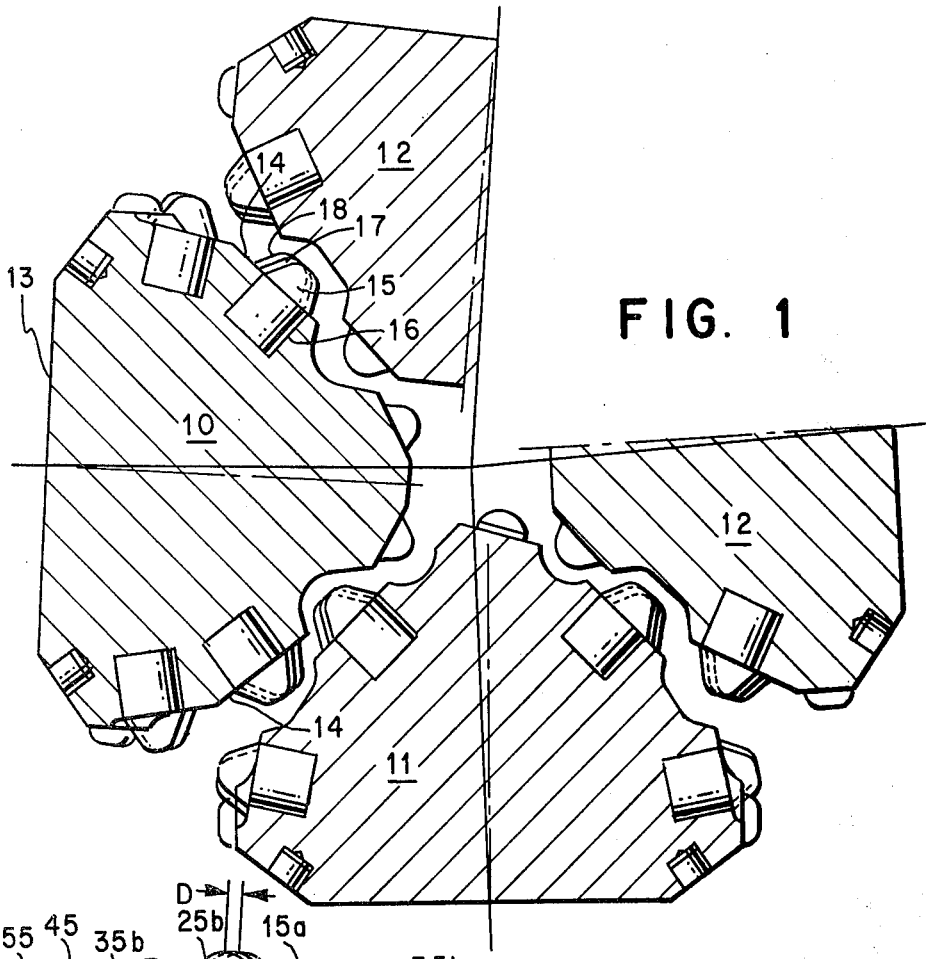
FIG. 1 is a cross-sectional plan view of the three cutter cones of a drill bit which embody the present invention.

FIG. 1 is a typical cutter layout of the three conical cutters of a rolling cone drill bit. Because the cutters are located in non-planar relationship the single dimensional layout of the cutter relationship necessarily requires the distortional effects resulting from this projection. As a result one of the cones must be split in half as illustrated in order to show the intermeshing relationships of the inserts on one cone with those of the adjacent cones. In FIG. 1 the three conical cutters 10, 11, and 12 are illustrated in schematic cross-sectional view. Each cutter comprises a generally conical body 13 upon which are circumferentially located raised insert lands 14 which pass circumferentially around the conical surface of cutter 10. A plurality of hard metal cutting elements 15 commonly termed inserts, such as of tungsten carbide are located in cylindrical bores 16 drilled into cone 10 perpendicular to the surface of land 14. Inserts 15 have cylindrical base portions secured tightly in the recesses 16 by means of an interference fit. The interference fit is achieved by boring holes 16 slightly smaller in diameter than the diameter of the cylindrical portion of inserts 15. The inserts also have portions projecting outwardly from the roller cutter body. These projecting portions when viewed in section on a longitudinal central plane of the cutter body 13 presenting opposing sides tapering to a generally blunt tip engageable with the bottom of the well bore.

The present invention is distinctly illustrated in FIG. 1 by the offset pattern of inserts 15, 17 and 18 projecting upwardly from land 14. In conventional designs all of the inserts in a land 14 would be located basically on the same circumferential circle on the cutter surface. In the present invention the inserts in the land 14, constituting an intermediate row of inserts, are located in different concentric circumferential circles around the cutter. This new cutter profile having offset or staggered inserts allows a greater bottom hole coverage with the same number of inserts and greatly reduces the tendency of the cutters to follow grooves in the well bore bottom. This reduction of the tracking tendency serves to reduce bit gyration and orbital action of the bit in the bottom of the bore hole. More particularly, the longitudinal centerlines of the base portions of the inserts of pairs of inserts in the intermediate row are spaced apart a predetermined offset distance D in the direction of the longitudinal axis of the cutter body. The distance D is less than the radius of the base portion of an insert, with the blunt tip of one insert of a pair of adjacent inserts being in overlapping relationship with the blunt tip of the other cutting element of the pair.

Figure 2:
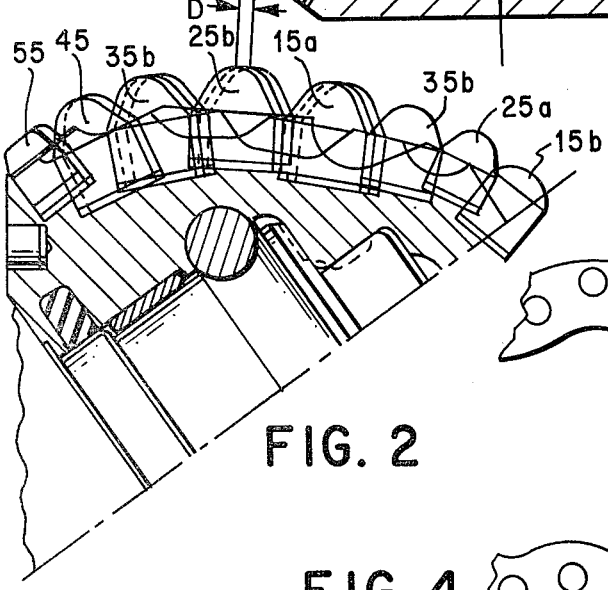
FIG. 2 is a partial cross-sectional view of a cutter cone illustrating the insert patterns of the present invention.

FIG. 2 illustrates an overlapping cutter profile showing the positioning of all of the inserts on the different cutters of a single bit. The inserts 15*a* and 15*b* in FIG. 2 represent those inserts of cutter 11. Inserts 25*a* and 25*b* are those of cutter 10 and inserts 35*a* and 35*b* are the inserts of cutter 12. Inserts 45 are the inserts of cutters 10 and 11 and inserts 55 are inserts on all three cutters. The inserts at 55 are normally termed gage row inserts and are offset in the same manner as the inserts of the intermediate row.

Figure 3:
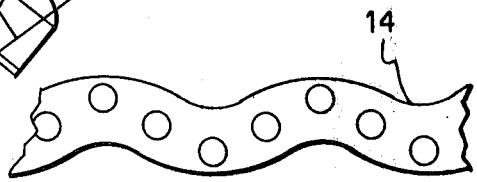
FIG. 3 is a partial developed view of one of the cutter cones showing the positioning of the inserts on the cutter cone.
Figure 4:
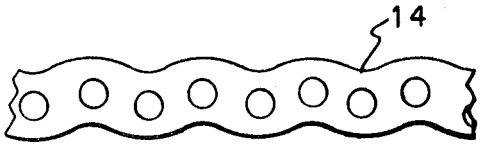
FIG. 4 is view similar to FIG. 3 showing the positioning of the inserts of a second embodiment of the drill bit.

Referring to FIGS. 3 and 4 the staggered or offset inserts pattern may be seen more clearly. In FIG. 3 a sinusoidal insert pattern is disclosed wherein the inserts have three basic locations along the land 14. Each insert is offset approximately the same amount in a lateral direction from each adjacent insert and basically ends up with three closely associated rows of inserts in the same land. This pattern differs from the normal widely spaced rows of inserts on the conventional cutters in that each insert row in a single land is primarily overlapping each adjacent row with only a slight amount of offset to one side or the other. The amount of offset in the land 14 has been exaggerated in order to more clearly portray the pattern of inserts. Likewise, the land has been flattened out to illustrate the insert pattern but because of the circular conical shape of the cutter land 14 would normally not be a straight flat surface.

FIG. 4 illustrates a second embodiment of the insert design wherein the land 14 contains only two insert locations each slightly offset from the other and both overlapping each other substantially.

Thus, the present invention discloses a new drill bit cutter profile utilizing non aligned cutter inserts in each insert land on each of the conical cutters. The non-aligned or staggered inserts provide a better coverage of the bottom hole surface, for reducing the thickness and shear strength of any annular ridges which may form on the well bore bottom and thus the capacity of such ridges for holding the drill bit in an off-center rotation pattern (i.e., reducing the tendency for bit gyration). As a result, breakage of inserts, destruction of cutter structures, and bearing failure are greatly reduced without sacrificing the normal rate of penetration of the drill bit.

Although a specific preferred embodiment of the present invention has been described in the detailed description above, the description is not intended to limit the invention to the particular forms of embodiments disclosed therein since they are to be recognized as illustrative rather than restrictive and it will be obvious to those skilled in the art that the invention is not so limited. For instance, whereas the insert patterns as described and illustrated in FIGS. 3 and 4 are of the sinusoidal configuration, it is clear that other offset or staggered patterns could also be utilized efficiently. Thus, the invention is declared to cover all changes and modifications of the specific example of the invention herein disclosed for purposes of illustration which do not constitute departure from the spirit and scope of the invention.

The embodiments of the invention in which an exclusive property or privilege is claimed are defined as follows:

1. A roller cutter for a rotary drill bit of the type having a plurality of bearing journals and roller cutters at its lower end and used to drill well bores in relatively tough formations which tend to form annular ridges on the well bore bottom which hold the drill bit in a pattern of rotation about other than its geometric centerline, the roller cutter comprising:

a generally frustoconical cutter body having a recess in the base thereof adapted to receive a bearing journal, and a plurality of bores of generally circular shape in transverse section in the conical outer surface thereof; and a plurality of elongate cutting elements of a tungsten carbide material, one for each of said bores, each cutting element having a generally cylindrical base portion secured in the respective bore and a portion projecting outwardly from the roller cutter body, said projecting portion when viewed in section on a longitudinal central plane of the cutter body presenting opposing sides tapering to a generally blunt tip engageable with the bottom of the well bore, the cutting elements being arranged in a plurality of generally annular rows around the cutter body, a first row being adjacent the base of the roller cutter body and constituting a gage row, and a second row being between the gage row and the apex of the cutter body and constituting an intermediate row, the cutting elements of said intermediate row being spaced at generally equal intervals around the cutter body with the longitudinal centerlines of the base portions of the cutting elements of pairs of cutting elements in the intermediate row being spaced apart a predetermined offset distance in the direction of the longitudinal axis of the cutter body, with said offset distance being less than the radius of the base portion of a cutting element, and with the blunt tips of one cutting element of a pair of adjacent cutting elements being in overlapping relation with the blunt tip of the other cutting element of the pair, when the roller cutter is viewed in longitudinal central section, whereby, upon rotation of the drill bit, the cutting elements of the intermediate row engage the bottom of the well bore over a relatively wide annular area for reducing the thickness and thus the shear strength of any annular ridges forming on the well bore bottom and thus the capability of such ridges for holding the drill bit in an off-center rotation pattern.

2. A roller cutter as set forth in claim 1 wherein the projecting portion of each cutting element is of generally frustoconical shape.

3. A roller cutter as set forth in claim 1 wherein the cutting elements of the intermediate row are so arranged that the centerlines of the base portions of the cutting elements intersect a generally sinusoidal line extending around the roller cutter body.

4. A roller cutter as set forth in claim 3 wherein at least three cutting elements are included in each cycle of the sinusoidal line.

* * * * *